United States Patent [19]

Sundström

[11] 3,978,884

[45] Sept. 7, 1976

[54] POSITION REGULATOR

[75] Inventor: Nils Eskil Sundström, Sodertalje, Sweden

[73] Assignee: AB Westin & Backlund, Stockholm, Sweden

[22] Filed: Aug. 18, 1975

[21] Appl. No.: 605,294

[30] Foreign Application Priority Data

Mar. 24, 1975 Sweden ..... 7503346

[52] U.S. Cl. ..... 137/495; 92/13.6; 92/63; 92/65; 251/285

[51] Int. Cl.[2] ..... F15B 15/24

[58] Field of Search ..... 91/167 R; 92/13, 13.3, 92/13.5, 61, 63, 65, 62; 251/285; 137/495, 505, 505.38

[56] References Cited

UNITED STATES PATENTS

| | | | |
|---|---|---|---|
| 2,833,303 | 5/1958 | Leutwiler et al. | 137/495 |
| 2,853,268 | 9/1958 | Hughes | 251/285 |
| 3,176,870 | 4/1965 | Cruse | 92/63 X |
| 3,295,423 | 1/1967 | Cox et al. | 92/63 |
| 3,439,585 | 4/1969 | Herrera | 92/63 |
| 3,913,448 | 10/1975 | Priestley et al. | 92/62 |

*Primary Examiner*—Henry T. Klinksiek
*Attorney, Agent, or Firm*—Schiller & Pandiscio

[57] ABSTRACT

A position regulator is provided which is effective to control, via a control unit, a pressure medium circuit to operate a different working pressures. The regulator comprises two or more pistons dividing a common cylinder into a number of pressure chambers, the pistons being arranged for movement relative to one another. The invention provides stop means for each separate piston, each stop means being individually adjustable to produce different lengths of stroke for the respective pistons whereby the output piston rod from the cylinder is caused to adopt a number of axially determined limit positions depending upon the control pressure applied to respective pressure chambers.

5 Claims, 4 Drawing Figures

POSITION REGULATOR

Figure 1:
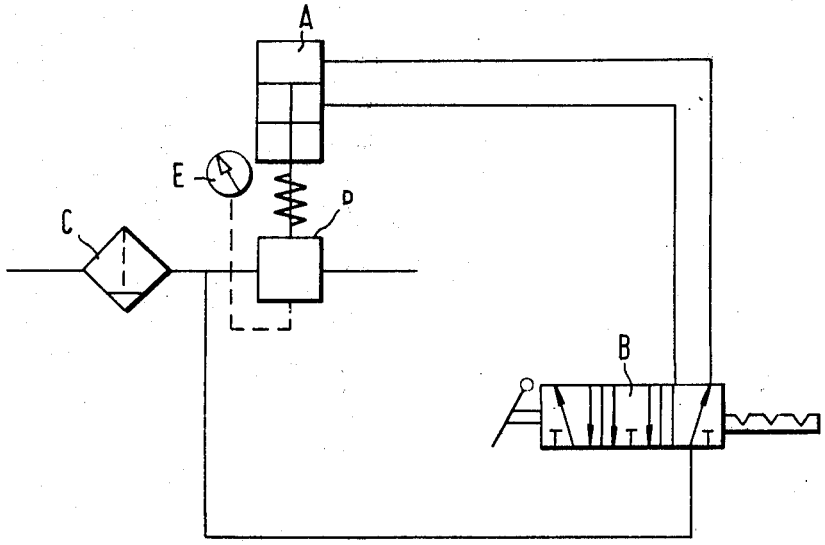

The present invention relates to a position regulator which is effective to cause a control unit incorporated in a pressure medium circuit to adopt a number of determined positions for adjusting the working pressure of the pressure medium on the outlet side of the control unit, said position regulator comprising at least two pistons which are arranged in a cylinder for movement relative to one another and which divide the cylinder into a number of pressure chambers to which working medium is supplied in dependence upon control means for displacing said pistons, of which pistons one extends axially through the cylinder to co-act with the control unit and the rear face of said piston is formed so as to permit said piston to co-operate with the other piston located therebehind.

The working pressure of a pressure medium is often set by manually adjusting a control unit. Such adjustment of the working pressure requires in each instance an indication of the prevailing pressure on a measuring instrument, although it may nevertheless be difficult from time to time to obtain the same working medium setting. This is particularly true of pneumatic control valves, so-called pressure regulators. In industry, because of the difficulties encountered when setting the working pressure of pressure regulators, the time consuming adjustments to control units in pressure medium circuits are often avoided and instead, when a plurality of different working pressures are required at a working station these pressures are obtained by using separate lines incorporating reduction valves for each particular purpose. These reductions valves are each adjusted to a position which in conjunction with a given setting position of a main valve gives rise to a predetermined pressure of the pressure medium in an output line of a working machine or the like.

Such arrangements are found, for example, on the assembly floors where complicated industrial products are produced in series. At an assembly station, the operator may be required to tighten screws, and/or nuts of different dimensions. This requires different torques and because of this the auxiliary tool used by the operator must be adjustable with respect thereto. With regard to the difficult adjustments to the working pressure of a pressure-medium operated machine, it is often necessary for an operator to use a plurality of such machines capable of tightening screws and/or nuts to different torques during the assembly of a complicated unit. This means that the machines and the pressure-medium lines connected thereto require considerable space at an assembly station, thereby rendering difficult the various operations which must be performed. The machines and control units required for the assembly station require a large outlay.

With the view of improving these conditions it is known to use in conjunction with pneumatically-operated machines a control system which enables only one machine to be used for, for example, three different tightening operations. Such a control system, however, requires that compressed air from a main line, is assigned one of three pressure regulators each of which is controlled by a manually actuatable control valve so as to pass compressed air to a main valve upstream of the machine. With this arrangement the number of machines at an assembly station is considerably reduced, although, on the other hand, the control equipment is much more complicated. In this respect, the equipment is much too expensive to be used in conjunction with single-spindle machines. Furthermore, a sufficiently precise tightening torque cannot be obtained with such a control system, owing to the fact that the function of the remote-controlled main valve is based on the balancing of the main air pressure against the controlled air pressure. This causes an air-cushion-dependent regulation of the working pressure of the machine with a large variation area.

The object of the present invention is to eliminate the aforementioned disadvantages and the invention relates to a position regulator in a control system for a pressure-medium operated machine which can be switched-over for different torque requirements. To make this possible it is necessary that the pressure medium supplied to the machine can be controlled so as to adopt working pressures corresponding to predetermined moment values, for example, tightening torques for bolt joints of three or more different dimensions. In accordance with the invention this is achieved with a position regulator which is effective to cause a control unit in a pressure medium circuit to adopt a number of determined positions for setting the working pressure of the pressure medium on the outlet side of the control unit, said position regulator comprising at least two pistons which are arranged in a cylinder for movement relative to one another and which divide the cylinder into a number of pressure chambers to which the pressure medium is supplied in dependence upon control means so as to displace the pistons, of which pistons one has an axial extension through the cylinder for co-action with the control unit and the rear face of said one piston is formed to co-act with the other piston, which is located therebehind. The invention is characterized by the fact that fixedly mounted in the cylinder are stop means for each separate piston, and in that the stop means are individually adjustable for different lengths of stroke of respective pistons, wherein the output piston rod or the like of the cylinder is imparted a number of axially determined limit positions depending upon the control pressure in respective pressure chambers.

The invention is also characterized by the fact that the stop means for adjusting the length of stroke of respective pistons in the cylinder is effected by means of manually actuatable setting means and locking means. In one advantageous embodiment of the position regulator, the invention is also characterized by the fact that the rearmost piston in the cylinder is provided in the rear face of said piston with a blind hole in which stop means are arranged to determine the end positions of the piston in both directions. A position regulator according to the invention adapted for connection to a known pneumatic pressure regulator with manual setting of the valve function by actuating one end of an axial pressure spring is characterized in that the cylinder neck at the outer end is provided with screw threads which, upon unscrewing manual setting means on the pressure regulator, fit into exposed threads therein, and in that the output piston rod of the cylinder is arranged with such an assembly to engage the end of the adjuster spring of the pressure regulator.

Figure 4:
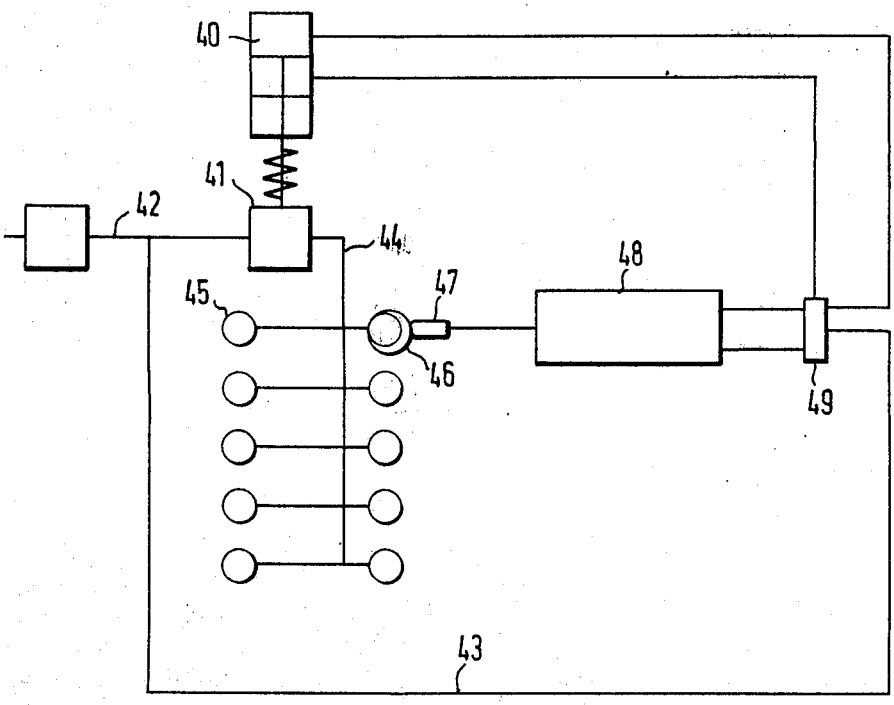
Figure 2:
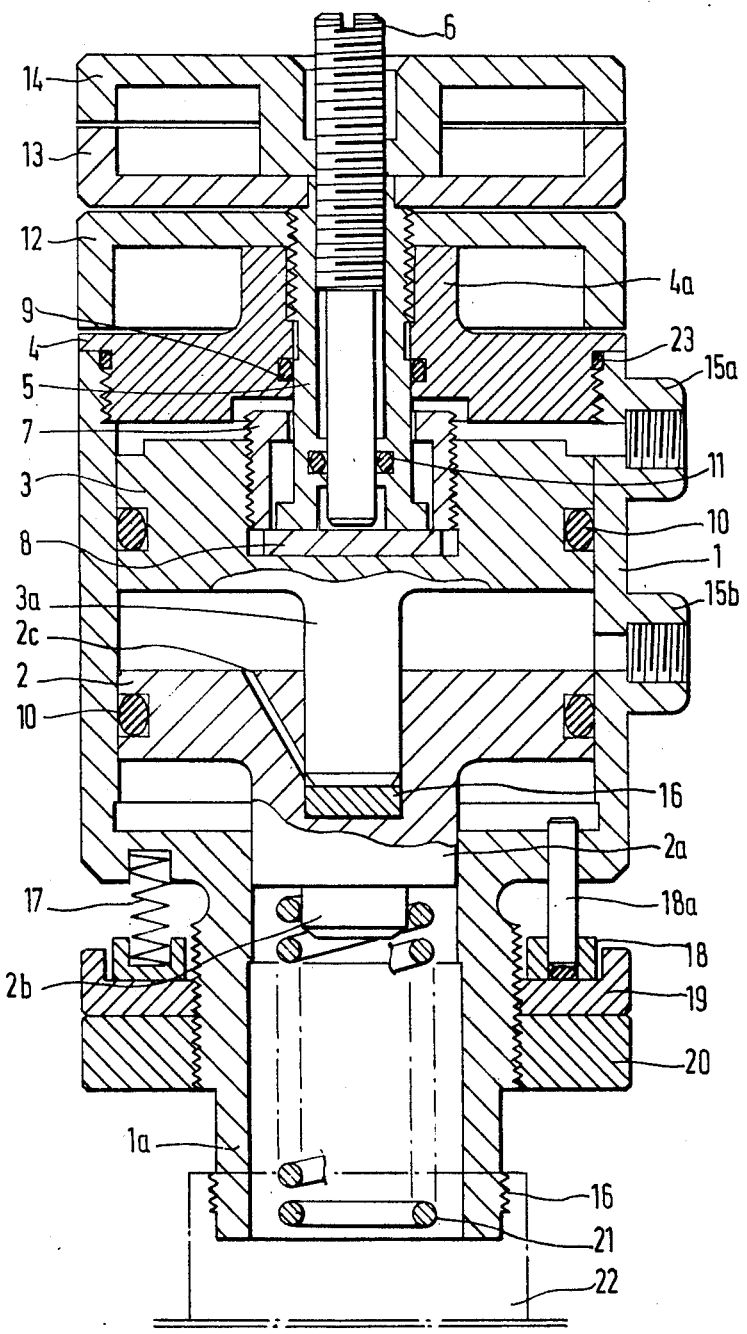
Figure 3:
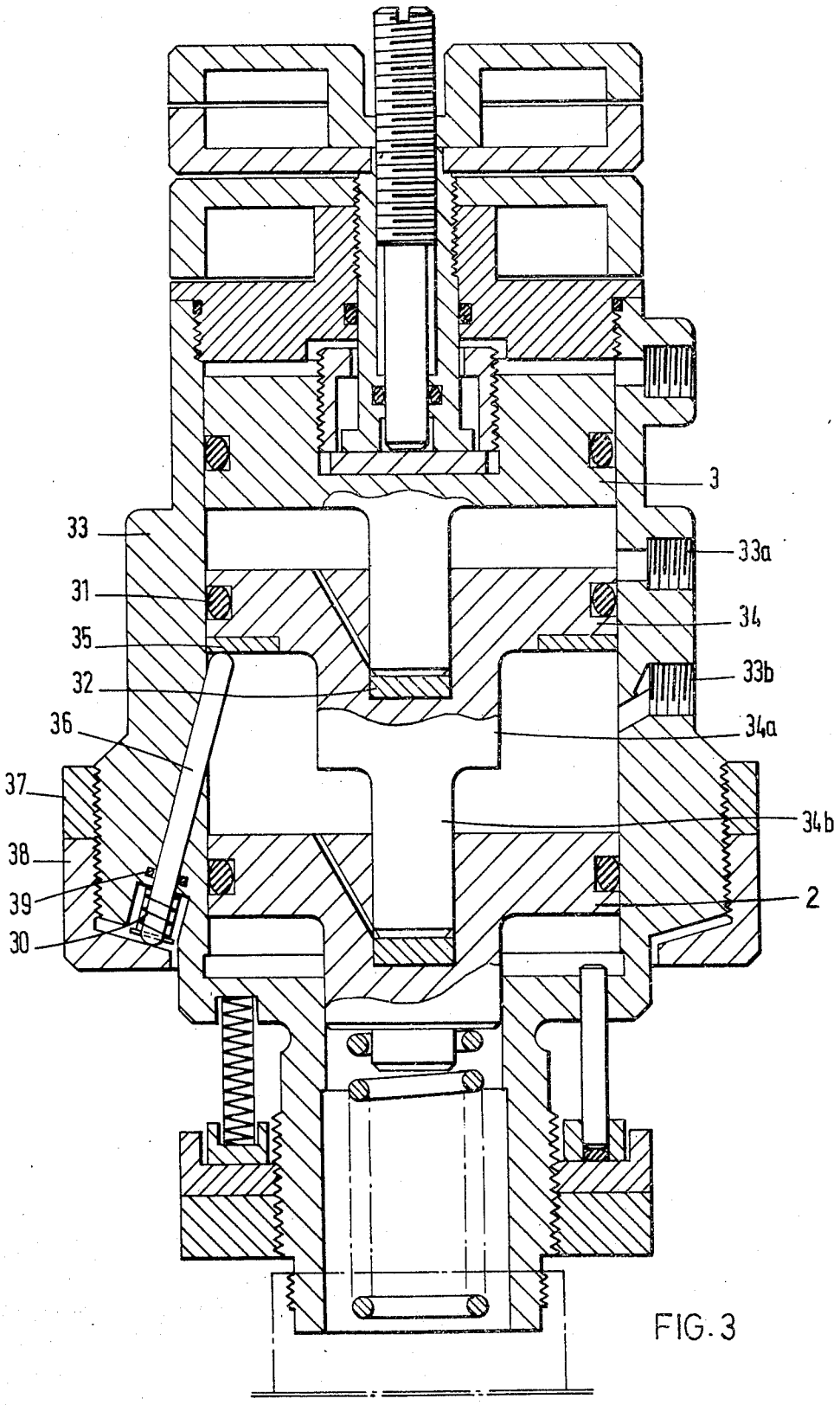

The invention will now be described in more detail with reference to the accompanying drawings, in which FIG. 1 shows a pneumatic control system comprising a position regulator according to the invention, FIG. 2 is a longitudinal sectional view of a three-position regulator, FIG. 3 shows in similar manner a four-position regulator and FIG. 4 shows the application of a position regulator constructed in accordance with the invention in an automated control function.

The control equipment shown in FIG. 1 comprises a position regulator A which, under the influence of a conventional three-position valve B in a branch line of a main air line C connected to a source of compressed air, is adapted to control a pressure regulator D in a manner which enables said pressure regulator to adopt valve positions which correspond to three different pressure levels on the output side of the pressure regulator D, which pressure levels can be read off from a manometer E. The control equipment can be used for controlling the working pressure of screw and nut tightening auxiliary tools used in industrial assembly stations. With such use, the three different working pressures are set only once, by manual adjustment of the position regulator A. Subsequent to making the said settings, only the three-position valves B need be availably placed adjacent the working position of the operator or on the auxiliary tool used by said operator, since the operator by means of the three-position valve can remotely control the position regulator so as to adjust said regulator from one working pressure to another, pre-determined pressure for the auxiliary tool. In effecting switching of the pressure regulator from one working pressure to another, the pressure regulator is caused to move axially by the position regulator, wherein an adjuster spring 21 arranged in the pressure regulator is compressed to different degrees of compression so as to influence the valve function of the pressure regulator in a known manner and to apply a different reduction effect to the fluid passing through the pressure regulator. When the adjuster spring 21 is not actuated, the pressure regulator valve is closed, while when the spring 21 is in a compressed state, the spring pressure balances the air pressure via a membrane so that the valve either opens or closes in dependence upon the air consumed on the outlet side of the pressure regulator.

The purpose of the position regulator A according to the invention is to control these compressions by causing the adjuster spring 21 to be displaced axially to pre-determined positions corresponding to a given working pressure on the outlet side of the pressure regulator D. To this end, the position regulator A shown in FIG. 1 is arranged to cause the adjuster spring 21 to be compressed to three alternative degrees of compression corresponding to pre-determined axial displacement movements of an outgoing piston rod in the position regulator A.

The axial displacement movements are initiated by manually operating the three-position valve B. As previously mentioned, the valve B is arranged in a branch line of a main air line C and, in a known manner, air can be passed via the same to each of two separate inlets to the position regulator A. In addition to the beforementioned two control positions, the three-position valve can be set to a third position, in which the position regulator is not activated by the pressure medium. Such a setting causes the position regulator A to adopt a pre-determined output position which permits the adjuster spring 21 in the pressure regulator D to be compressed to a certain degree.

A pressure regulator A forming part of the exemplified control system according to FIG. 1 will now be described in more detail hereinafter with reference to FIG. 2.

Two pistons 2 and 3 are movably arranged in a cylinder 1. At one end thereof the cylinder 1 is provided with a neck 1*a* having a centre hole which is arranged to engage a hub 2*a* formed on the piston 2 so as to provide a bearing for said hub during a displacement movement of the piston 2. Externally of the hub 2*a*, the piston is provided with a piston pin 2*b*, hereinafter referred to as the piston rod. This is arranged to engage in one end of a pressure spring 21 forming part of a pressure regulator D, the setting of which is changed by the position regulator A through compression of the pressure spring 21.

Maximum compression of the spring 21 is defined by the maximum displacement of the piston 2 in a direction towards the cylinder neck 1*a*. Displacement of the piston 2 in said direction is stopped by three co-acting pegs 18*a*. These are arranged in a circle on an abutment plate 18 and pass through free holes in the cylinder wall so that said pegs axially project into the cylinder chamber. Between the pegs 18*a*, and on the same circle as the pegs are located, the abutment plate is provided with three blind holes, which house three pressure springs 17, the other ends of which are received in corresponding blind holes arranged in the cylinder wall. The abutment plate is urged by the pressure spring 17 into abutment with a setting plate 19 which is screwed onto the cylinder neck 1*a*, and the setting plate 19, and consequently the pegs 18*a*, are locked in an adjustable position by means of a locking plate 20 which is screwed into abutment with the setting plate 19.

The other end of the cylinder 1 is closed by an end wall 4 which is screwed into said cylinder and which is sealed against the cylinder by means of a sealing strip 23. The end wall 4 is provided with an outwardly projecting neck 4*a*, the centre hole of which forms a bearing for an inwardly extending stop sleeve 5. The inner end of the stop sleeve 5 is provided with a flange which comprises the actual stop means. At the other end of its axial extension, the stop sleeve 5 is provided with both external and internal screw threads. The external screw threads co-act with corresponding threads in the outer portion of the centre hole of the end wall 4, while screwed into the internal threads is a stop shaft 6, an inner extension of which passes through a centre hole in the stop sleeve 5, said centre hole being sealed by a sealing ring 11. The flanged inner portion of the stop sleeve 5 engages a blind recess in the piston 3. Abutting the bottom of said recess is a plate 8 which is held in position by a sleeve 7 which is screwed into the recess and the free end of which is provided with an inwardly extending flange which, through free holes, embraces the hub of the stop sleeve 5 and forms a chamber between the plate and the flange. In this way, the flange of the stop sleeve 5 is locked between two walls which define the axial movements of the piston 3 relative to the stop sleeve 5.

The axial movements of the piston 3 are also defined by the stop shaft 6, since the plate 8 is pressed into abutment with the inner end of the stop shaft. By adjusting respective stop means 5, 6 axially, the displacement movements of the piston can be regulated for different conditions which are described hereinafter. To enable the stop sleeve 5 to be adjusted, the outer end of said sleeve is provided with a circular shoulder having two diametrically opposed flats for dogging co-action with an adjustment knob 13. A locking knob 12 is threaded on the hub of the stop sleeve 5 inwardly of the circular shoulder, said locking knob 12 being effective to lock the axial position of the stop sleeve 5 set by the setting knob 13 by forcing the locking knob 12 against the rear end of the hub 4*a* on the end wall 4.

For adjusting the stop shaft 6, the outer end thereof is provided with a diametric groove which enables a screw driver to be used for setting the axial position of the shaft. Screwed onto the stop shaft 6 is a locking knob 14 with which the stop shaft 6 is locked in a set position by tightening the locking knob 14 against the setting knob 13. This construction means that the position of the stop sleeve 5 should be set and locked prior to setting and locking the stop shaft 6.

The piston 3 is provided at the other end thereof with a hub pin 3*a* which engages in a blind hole in the piston 2. Arranged at the bottom of said hole is a plate 16 which, when the piston pin 3*a* is pressed thereagainst limits movements of pistons 3, 2 relative to one another. To prevent the formation of an air cushion upon movement of the pistons towards each other, the piston 2 is provided with a venting channel 2*c* which permits air to escape from the blind hole. The channel 2*c* is preferably so dimensioned that a constriction effect is obtained, thereby dampening the movement of the pistons, 2, 3 towards each other.

As will be understood from the aforegoing, the pistons 2, 3 can be displaced in the cylinder 1 either independently of each other or together. Which of these alternatives is utilized during a control function, depends on how compressed air is supplied to the cylinder 1. With the exemplified position regulator, two pressure chambers are defined in the cylinder 1, one between the piston 3 and the end wall 4 and the other between respective pistons 2 and 3. The pressure chambers are sealed in respect of each other and the surroundings by means of piston seals 10 and the beforementioned sealing rings 9, 11, 23. The inlet to respective pressure chambers has the form of nipples (not shown) which are screwed into shoulders 15*a* and 15*b* having threaded holes therefor and fixed to the cylinder 1.

In the starting position, which comprises the first control position of the position regulator, the piston 2 abuts the piston rod 3*a* and the piston 3 abuts the end of the stop shaft 6 under the action of the adjuster spring 21 of the pressure regulator. The adjuster spring is thus compressed to a certain extent, which provides a pre-determined working pressure on the outlet side of the pressure regulator.

In the second control position, pressure medium is supplied to the pressure chamber between the piston 3 and the end wall 4, the pistons 2 and 3 being moved together until the piston 3 is stopped by the inner flange on the stop sleeve 5, via the sleeve 7.

In the third control position, pressure medium is supplied to the pressure chamber between the pistons 2 and 3, whereupon the piston 3 is held in abutment with the stop shaft 6, while the piston 2 is pressed into abutment with the stop pins 18*a*. The end pistons 2 and 3 in the exemplified position regulator of FIG. 3 has the same mode of operation. With the embodiment of FIG. 3, an intermediate piston 34, provided with a sealing ring 31, is displaceably mounted in a cylinder 33. Together with the end pistons 2 and 3 a pressure chamber is formed on both sides of the intermediate piston 34. The rear face of the intermediate piston 34 is constructed in the same manner as piston 2 and in the bottom of the blind hole is arranged a plate 32 against which the piston rod 3*a* abuts in the starting position. The piston 34 is provided on its front face with a hub 34*a* and an extended piston rod 34*b* which engages the blind rear hole on the piston 2. Securely mounted to the front face of the piston 34 is an abutment plate 35 by means of which the piston 34 is urged into abutment with at least one stop rod 36 upon forward axial movement of the piston 34. The stop rod 36 is displaceably mounted in a longitudinally extended groove in the wall of the cylinder 33. The groove is slightly inclined relative to the cylinder axis and receives a sealing ring 39 for sealing the pressure chamber between the pistons 2 and 34. Securely mounted in the outer end of the stop rod is a plate and between said plate and the bottom of a blind hole in the cylinder housing there is arranged a pressure spring 30 which urges the outer end of the stop rod 36 abutment with a setting ring 38 screwed onto the cylindrical surface of the cylinder 33. The setting ring 38, and thus also the stop rod 36, are locked in a set position by means of a locking ring 37 which is threaded on the cylindrical surface of the cylinder 33.

With the embodiment shown in FIG. 3, the position regulator obtains a further control position since the number of pressure chambers is increased to three with inlet passages 33*a* and 33*b* and the previously mentioned channel via shoulder 15*a*. Each piston can be adjusted to an individual length of piston stroke and the manner in which the pistons co-operate with each other is the same as that described with reference to the three-position regulator.

A position regulator according to the invention can be used in both hydraulic and pneumatic control systems, wherewith in the former case the position regulator can be adapted to control a conventional slide valve. With such application it is only necessary to provide the position regulator and slide valve with pressure medium return lines. In all other respects, control is effected analagously with the exemplified pneumatic control system.

The position regulator according to the invention can also be used in an automated control system, such application being shown in FIG. 4. In this instance a position regulator 40 is arranged to control a pressure regulator 41 which controls the pressure from a main air line 42 to adopt working pressure in an output line 44 to a machine 45 having ten working spindles. On one of these spindles there is mounted a measuring means 46 the movements of which are sensed by an electromagnetic transducer 47 or the like, which transmits a signal to an electronic unit 48. The electronic unit 48 is provided with time-dependent control means and, in dependence upon speed-indicating signals transmitted by the transducer 47, the electronic unit controls a magnet valve for passing air to the position regulator 40 from a branch line 43 of the main air line 42. With the illustrated control function, the transducer causes automatic switching to the next highest value of working pressure when the speed-sensing spindle has stopped as a result of a pre-determined tightening torque being fully utilized. In other words, the arrangement enables a stepwise switching to different tightening torques with positions for the working pressure of the pressure medium determined by the position regulator. The application exemplified in FIG. 4 describes an electronic sensing of the speed of the spindle, although it is possible within the scope of the invention to sense said speed by pneumatic measuring and control means.

Within the scope of the industrial use of the position regulator, the control equipment can be supplemented with microswitches which sense the size of a sleeve mounted on the working machine and in dependence thereupon automatically cause switching of the position regulator for setting of a pre-determined tightening torque for the sleeve in question. Such sensing and switching may be alternatively effected by means of compressed air valves or the like.

As will be understood from the aforegoing, the position regulator according to the invention can be adapted for use in a plurality of different fields and therewith obtain modified forms. The invention is thus not restricted to the described embodiments but can be modified within the scope of the following claims.

What I claim is:

1. A position regulator for a control unit for a pressure medium circuit, the position regulator being operative to cause the control unit to adopt a number of determined positions for adjusting the working pressure of the working medium on the outlet side of the control unit and comprising at least two pistons, a common cylinder in which the pistons are arranged for movement relative to one another and divide the cylinder into a number of pressure chambers for receiving pressure medium supplied in dependence upon control means, and an axial extension provided on one face of at least one piston and extending through the cylinder for co-action with the control unit, the other face of said one piston being formed for co-action with the piston lying therebehind, wherein the improvement comprises stop means fixedly mountably in the cylinder for each separate piston, adjustment means for each stop means for effecting individual adjustment for different lengths of stroke of respective pistons whereby the piston rod or the like providing the output of the cylinder can be caused to adopt a number of axially determined limit positions depending upon the control pressure applied to respective pressure chambers.

2. A position regulator according to claim 1, wherein the adjustment means for adjusting the length of stroke of respective pistons via the stop means comprises manually actuatable setting means and locking means.

3. A position regulator according to claim 2, wherein the piston furthest from the control unit end of the cylinder has an outer face which defines a blind hole in which stop means are arranged to determine the limit positions of the said furthest piston in both directions.

4. A position regulator according to claim 2, wherein the control unit end of the cylinder defines a neck portion, and stop means for the piston nearest this end comprises a number of axial stop pins, and an annular abutment plate located around said neck portion to which said pins are attached, the abutment plate being arranged to lie against the adjustment means in the form of setting and locking rings threadedly attached to said neck portion.

5. A position regulator according to claim 1, when used in conjunction with a known pneumatic pressure regulator having manual adjustment of the valve function by actuation of one end of an axial pressure spring, wherein the cylinder neck at the outer end is provided for connection to the pressure regulator during removal of the manual adjustment means of said pressure regulator, and wherein the piston rod, which passes out of the cylinder brackets, is arranged to engage in the outer end of the axial adjustment spring of the pressure regulator when the position regulator is assembled to the pressure regulator.

* * * * *